US007204741B2

(12) United States Patent
Giese

(10) Patent No.: US 7,204,741 B2
(45) **Date of Patent: *Apr. 17, 2007**

(54) BRASSIERE FOR IMPROVED BREAST SUPPORT AND ENHANCEMENT

(76) Inventor: Sharon Giese, 114 E. 61st St., New York, NY (US) 10021

( * ) Notice: Subject to any disclaimer, the term of this patent is extended or adjusted under 35 U.S.C. 154(b) by 0 days.

This patent is subject to a terminal disclaimer.

(21) Appl. No.: 10/960,305

(22) Filed: Oct. 7, 2004

(65) Prior Publication Data

US 2005/0233677 A1 Oct. 20, 2005

Related U.S. Application Data

(63) Continuation-in-part of application No. 10/683,134, filed on Oct. 9, 2003, now Pat. No. 6,918,812.

(51) Int. Cl.
*A41C 3/10* (2006.01)
*A41C 3/00* (2006.01)

(52) U.S. Cl. ..... 450/65; 450/66; 450/75

(58) Field of Classification Search ..... 450/66, 450/65, 67, 69, 74.76, 70, 72, 73, 75, 92; 2/67, 73, 78.1–78.4, 69; 66/171, 176, 177, 66/172 E, 153, 170

See application file for complete search history.

(56) References Cited

U.S. PATENT DOCUMENTS

| | | | |
|---|---|---|---|
| 2,835,255 | A | 5/1958 | Becker |
| 3,595,243 | A | 7/1971 | Mount |
| 3,769,987 | A | 11/1973 | Markowitz |
| 3,957,057 | A | 5/1976 | Farino |
| 4,413,625 | A | 11/1983 | Footer |
| 4,453,549 | A | 6/1984 | DiTullio |
| 5,045,019 | A | 9/1991 | Capasso et al. |
| 5,098,330 | A | 3/1992 | Greenberg |
| 5,167,566 | A | 12/1992 | Novitsky et al. |
| 5,171,182 | A | 12/1992 | Heinen |
| 5,823,851 | A | 10/1998 | Dicker |
| 5,868,601 | A | 2/1999 | Kelemencky |
| 6,165,047 | A | 12/2000 | Scott et al. |
| 6,213,842 | B1 | 4/2001 | Degirmenci |
| 6,287,168 | B1 | 9/2001 | Rabinowicz |
| 6,685,534 | B2 | 2/2004 | Mitchell et al. |

FOREIGN PATENT DOCUMENTS

| | | |
|---|---|---|
| GB | 674354 | 2/1950 |
| GB | 673095 | 7/1950 |
| WO | WO 03/073878 A2 | 9/2003 |

OTHER PUBLICATIONS

Search report from European Patent Office citing five references ~ EP 04 02 4070.

*Primary Examiner*—Gloria M. Hale
(74) *Attorney, Agent, or Firm*—Anderson Kill & Olick, PC

(57) ABSTRACT

A brassiere comprising two brassiere cups each having an equal number of two or more panel sections representing by at least a lateral sling panel section and a main panel section respectively with the panel sections of each breast cup arranged such that the lateral panel section acts as a sling and possesses substantially less elasticity than is possessed by the main panel section and that the brassiere satisfies a narrow base width measurement for each breast cup of between 11.5 and 13.5 centimeters when the brassiere is extended. The main panel section should extend superiorly to cover the nipple area of the breast and possess greater elasticity.

16 Claims, 3 Drawing Sheets

FIG. 1
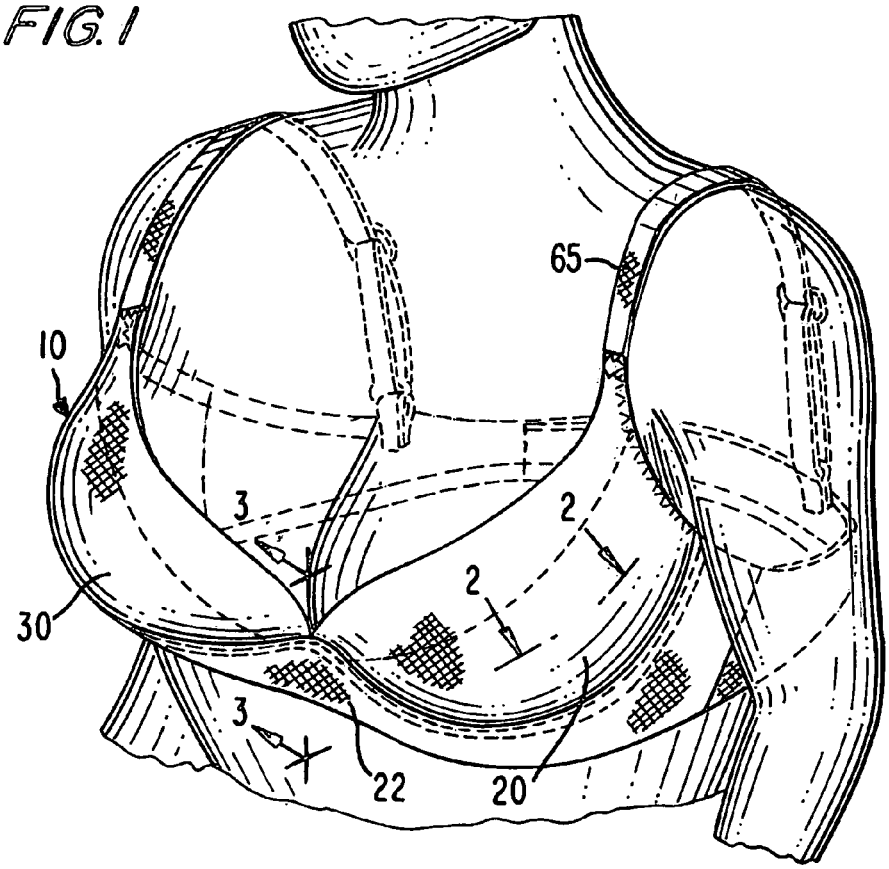
FIG. 2
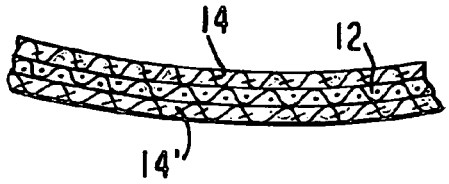
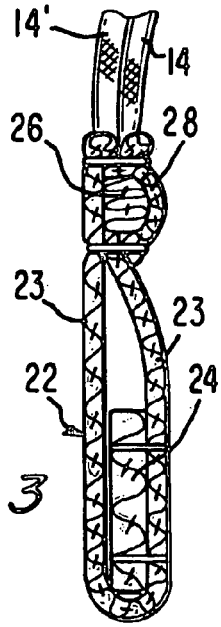
FIG. 3

BRASSIERE FOR IMPROVED BREAST SUPPORT AND ENHANCEMENT

This invention is a continuation in part of U.S. patent application Ser. No. 10/683,134 filed on Oct. 9, 2003 now U.S. Pat. No. 6,918,812, and relates to a brassiere for providing breast support, enhancement and cleavage control and more particularly to the construction of a soft cup (no underwire) brassiere which applies force in a medial direction for directing the breasts toward one another and in a superior direction relative to the chest wall for lifting the breasts upwardly without the use of an underwire or excessive padding.

FIELD OF THE INVENTION

Background of the Invention

Many attempts have been made in the past to construct a brassiere, which will provide improved breast support, and enhancement as is taught in the following patent disclosures:

U.S. Pat. No. 5,868,601, for example, teaches the use of externally placed support straps to pull the breast together so as to unnaturally create an enhanced cleavage line.

U.S. Pat. No. 5,098,330 employs elastomeric members to create compressive forces intended for use with added padding to push the breasts upwardly and inwardly toward each other. The arrangement is awkward and unwieldy as well as cosmetically unattractive.

U.S. Pat. No. 6,165,047 teaches a brassiere within a brassiere construction for use in combination with excessive padding to volumetrically enhance the breast. The inner cup is placed firmly against the breast, forcing the natural breast tissue away from the middle of the chest, which is directly opposite to the desired force direction to create cleavage.

U.S. Pat. No. 6,213,842 incorporates a stretchable band in each breast cup to control the forces on the breasts when tension is naturally applied to the band and a force to move the breasts laterally toward one another. However, the use of stretchable bands actually limits the lateral excursion of the breast when tension is naturally applied around the chest and, as such, limits the degree of breast enhancement.

U.S. Pat. No. 3,595,243 contemplates adding pull elements to provide elevation of the breast and U.S. Pat. No. 4,413,625 teaches shortening the side panels of the brassiere to cause breast elevation.

Other known techniques involve different measuring systems to measure bra sizes so as to permit the design of the bra to accommodate differences in volumetric breast size as well as differences in the perimeter of the breast on the chest.

All of the above prior art brassiere designs contemplate the use of extra padding, external supports, or an underwire as an integral part of the design. The prior art does not teach a brassiere design using a breast anthropometrical standard, applicable to most women, or correlating the breast cup diameter of the brassiere to the breast anthropometrical standard as taught in the present invention.

Accordingly it is an object of the present invention to provide a brassiere design, which will create breast enhancement, cleavage and support while maximizing the appearance of the natural breast volume without any reliance on extra padding or underwire.

Another object of the present invention is to present an anthropometric standard which, will be utilized to create breast cleavage for average to slightly above average weight women using a brassiere construction that satisfies the finding that the base width of the average woman's breast changes minimally over varying chest circumferences and cup sizes. Adhering to this correlation is critical to the creation of cleavage in the said group of women. Heretofore prior designs incorporated an underwire to maintain a brassiere's cup integrity.

Still another object of the present invention is to provide a brassiere construction, which will control breast cleavage using a design common to two breast cups with each cup formed of a minimum of two panel sections, designed with different elastic properties so as to maximally facilitate a force in the superior-medial direction required to create cleavage without underwire.

Yet another object of the present invention is an external main panel or covering fabric, which is molded from one piece of material eliminating seams. The smooth appearance under clothing further accentuates the natural exposed breast tissue, i.e., the cleavage.

Yet another object of the present invention is to provide an improved brassiere construction that can be economically manufactured for use as an independent brassiere or incorporated into many different garments, such as swimsuits and evening gowns for sale as one garment.

SUMMARY OF THE INVENTION

It is believed that a large percentage of women are accommodated with ill-fitted brassieres due to the lack of a reliable industry standard for correlating brassiere size with women's anatomy. It has been discovered in accordance with the present invention that an anthropometric standard does indeed exist to correlate brassiere size with the average women's anatomy which will enable a brassiere design to satisfy normal to slightly overweight women (limited to women who are not obese) having average to above average sized breasts.

The brassiere of the present invention is designed to support and exert force on the wearer's breasts to move them to a more superior and medial direction on the chest wall in accordance with an anthropometric standard. This anthropometric standard is achieved in accordance with the present invention by designing the brassiere to satisfy a narrow base width measurement for each breast cup when the brassiere is extended; i.e., when worn. The base width standard may be accomplished by controlling the base diameter of the breast cups and the different elasticities of the panel sections of the brassiere relative to one another such that the base width of each breast cup stays within a narrow measurement between 11.5 to 13.5 centimeters. Previously the base width of a soft (without underwire) brassiere breast cup when extended around the chest, significantly exceeded this measurement. A soft cup brassiere that meets this standard will provide support and promote cleavage for normal to slightly overweight women with average to somewhat above average breasts without the need for excess padding. Heretofore a soft cup brassiere was never designed to satisfy a limited base width measurement for each breast cup, which directly correlates to the base width of a woman's breast as taught in the present invention to accomplish the goal of cleavage creation.

From an overall perspective the brassiere of the present invention broadly comprises two brassiere cups designed with each cup having a minimum of two panel sections representing a main cup panel section and a lateral sling panel section. The main cup panel in this invention corresponds in function to the superior panel section referred to in the parent patent application. Independent of the number of panel sections, each breast cup should be arranged such that the main or superior panel section extends superiorly to cover the nipple area of the breast. The elasticity of the different panel sections of the brassiere should be controlled relative to one another such that the main or superior panel section possesses a substantially greater elasticity and with less resistance than is possessed by the other panel section(s). For purposes of the present invention the elastic properties of the fabric will be defined by the American Standard Testing Methods (ASTM) using ASTM strength and recovery testing to show the elastic properties of the fabrics and using ball bursting strength to demonstrate the varying resistance of the fabrics. Moreover, the choice of fabric contributes to maintaining the base width of each breast cup to a narrow range preferably between 11.5 to 13.5 centimeters.

BRIEF DESCRIPTION OF THE OF THE DRAWINGS

Other advantages of the present invention will become apparent from the following description of the invention when read in conjunction with the accompanying drawings of which:

FIG. 1 is a front perspective of a brassiere according to one preferred embodiment of the present invention;

FIG. 2 is a sectional view taken along the lines 2—2 of FIG. 1;

FIG. 3 is a sectional view taken along the lines 3—3 of FIG. 1;

DETAILED DESCRIPTION OF THE PREFERRED EMBODIMENTS

Figure 4:
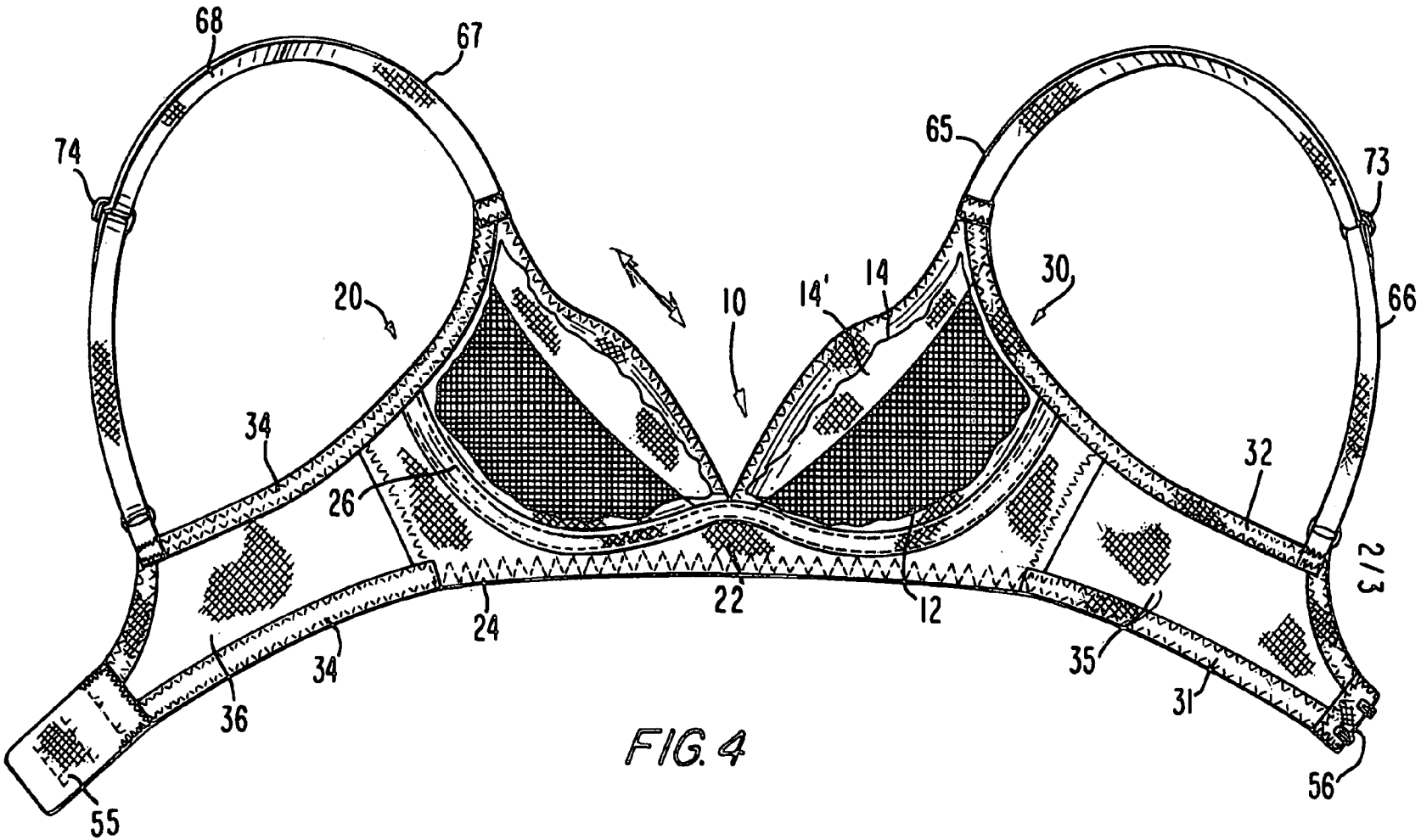
FIG. 4 is a posterior view of FIG. 1 with the main cup panel section of each breast cup shown broken away to expose the interior lateral sling panel section.

Reference is made to the first preferred embodiment of the invention inclusive of FIGS. 1–5. In FIG. 1 the brassiere 10 of the present invention is shown, for purpose of illustration, secured in place on the torso of a women's body. The brassiere 10 includes a first breast cup 20 and a corresponding second breast cup 30 interconnected at the medial as is shown in FIGS. 1 and 4. Anterior support member 22 also referred to as the chest band, is located beneath each breast cup 20 and 30. The anterior support member 22 is a single piece 23 of double faced knitted fabric with an elastic band 24, secured between the fold, of the fabric at its most inferior extent. Around the lower perimeter of each breast cup in between the breast cups 20, 30 and the anterior chest band 22 is soft support member, 26. The soft support member 26 is located in the area in which a conventional underwire (not shown) would otherwise be placed to form a typical underwire supported brassiere. The junction of the fabric of the anterior support member 22, the main breast cup panel 14, and the lateral sling panel 12 creates the soft support member 26. The soft support member 26 is a single piece 28 of double-faced knitted fabric secured about the soft support member 26, as shown in FIG. 3. The soft support member 26 also limits the extension of the base width of the breast cup 20, 30 when secured around the chest wall.

In this preferred embodiment of the invention each breast cup 20 and 30 has at least two separate panel sections, which, in combination, support the breast when worn by a user. The two panel sections of the breast cup 20 include the main cup panel section 14 and the lateral sling panel section 12 that is hidden from view by the main cup panel section 14. Likewise, the breast cup 30 includes a main cup panel section 14 and a corresponding lateral sling panel section 12 internal to the main cup panel section 14. Since the breast cup 20 and the breast cup 30 are of identical construction, only one breast cup, namely breast cup 30, will hereafter be further described in detail relative to the drawings with the understanding that the other breast cup 20 is constructed with a corresponding number of layers in the same arrangement and of the same materials. As will become more apparent hereafter the material(s) of construction for each of the two panel sections of each of the breast cups 20 and 30 play a significant role in the present invention relative to one another, to the soft support member 26, and the anterior chest band 22 and the other members of the brassiere 10. Any natural or synthetic fabric material may be used in the construction of the different panels as long as they satisfy the elastic properties of the panels in accordance with the present invention.

The description of the materials of construction for each of the two panel sections 12 and 14 of the breast cup 30 will now be explained with reference to FIGS. 1 through 4 inclusive. FIGS. 2 and 3 are sectional views indicative of a preferred arrangement for the number of fabric layers selected for each of the two panel sections 12 and 14 of the breast cup 30.

The main cup panel section 14 aids in the containment of the breast tissue and is constructed to possess the greatest elasticity, i.e., capacity to stretch based upon the ASTM stretch and recovery test when compared to the lateral sling section. The difference in elasticity is primarily established using different materials of construction (composition), which reflect the fabric stretch and resistance. The fabric is knitted and pre-molded. The fabric stretch is defined by a 130% average length stretch and a 75% average width stretch. The fabric growth shows a 10% average width growth after 60 seconds and 8% average after 60 minutes. The above stated tests reveal the elastic properties of the fabric. The fabric's ball bursting strength is 116 lbs. and reflects the resistance properties of the fabric. The main cup panel section 14 need only be composed of a minimum of one layer or may be constructed of two or more layers of fabric with the lateral sling section 12 placed in between the layers as is shown in FIGS. 2 and 4. The main cup panel which is smooth and pre-molded and possesses a greater elasticity in terms of its ASTM stretch and recovery and bursting strength test relative to the elasticity, based upon comparative ASTM tests, of the other panel section 12. The main cup section must provide enough force in a lateral medial direction as shown by the double-headed arrow in FIG. 4 to contain the breast tissue from being forced out of the brassiere. The main cup panel 14 should also extend superiorly to just cover the nipple areola complex of the breast. The main cup section 14 may be molded. The main cup panel section as described with one or more layers may also be embellished with any decorative covering such as lace.

The lateral sling panel section 12 is preferably a single layer of fabric located between the layers of the main cup panel 14. The inferior edge of the lateral sling panel section 12 is shaped to preferably follow the shape of the infra-mammary fold, lower curvature of the breast, and is secured to an anterior support member 22 of the brassiere 10 by the soft support member, 26. The lateral sling panel section 12 may extend superiorly up to or slightly above the nipple areola complex of the breast but is preferably located below the nipple areola complex of the breast and below the superior edge of the main panel section 14 as is evident from FIGS. 1 and 4 respectively. The lateral sling panel section 12 is also secured to a side panel 35 of the brassiere 10 at its lateral extent. The side panel 35 extends superiorly and laterally toward the anterior breast strap 65 to which the lateral panel section 12 is also secured by stitching 32. The fabric selected for the lateral sling panel is preferably knitted and should preferably have a fabric stretch defined by a 5.0% average length stretch and a 6.2% average width stretch. The fabric growth shows a 3.7% average width growth after 60 seconds and 2.5% average after 60 minutes and a 3.1% average length growth after 60 seconds and a 1.9% average after 60 minutes. The fabric resistance was assessed by the ball bursting strength and measured at 59.30 lbs. Therefore, the lateral sling panel section 12 has the least stretch and elasticity and the most resistance when compared to panel 14. The lateral sling panel sections of each breast cup 20 and 30 are minimally distensible and function to force the naturally, laterally falling breast tissue to a more superior and medial position when the brassiere is secured around the chest wall after appropriately adjusting the breast straps 65 and 66 respectively.

The above described cup panels 12, and 14 with their own unique elastic properties, for creating differing forces on the breast mound, when the brassiere 10 is secured about the chest wall (extended) can also be achieved by a single manufactured piece of fabric. The fabric would have the same above described differences in strength but are created internally in the fabric by e.g., modifying the denier of each of the selected panels for effectively controlling the elasticity and resistance. The same unique differences in elasticity and strength can be created in a single piece of woven fabric to create the same forces on the breast mound in each breast cup.

The anterior support member 22 bridging the two breast cups 20 and 30 is composed of at least two superimposed layers of material as shown in FIG. 3 with at least one layer designed to add structural integrity to the brasserie 10 by anchoring the breast cups 20 and 30 down. Additionally an elastic band 24 is in between the two layers of the anterior support member 22, as shown in FIG. 3. The anterior support member 22 has a superior border secured to the lateral sling panel section 12 of the breast cup 30 by the soft support member 26. Accordingly the superior border of the anterior support member 22 conforms in shape to the inframammary fold, lower curvature of the breast. The anterior support member 22 also extends rearward or is secured to the posterior support member 35 extending around the back of the wearer. The anterior support member 22 is preferably composed of at least two layers of superimposed fabric material, as is shown in FIG. 3. It also anchors the brassiere 10 to the chest when the posterior support member 35 and 36 are secured posterior. The tension created when the brassiere 10 is secured counters the superior tension pull forces from the brassiere straps 65 and 67, FIG. 4.

Each of the posterior support members 35, 36 for each breast cup 30 and 20 are joined together in the mid region of the back in any conventional fashion using, for example, a hook mechanism 55 and clips 56. The posterior support member 35 is composed of at least one layer of fabric. The anterior and posterior support member's anchors the brassiere to the chest and counterbalance the superior pull of the breast straps. The anterior and posterior support members have structural integrity derived from material fabrication and yield point and do not necessitate the use of a wire. Each posterior support member has elastic easing, 31, 34 FIG. 4, secured to the inner surface of the brassiere 10 on the superior and inferior borders. The elastic easing adds comfort for the wearer. The anterior brassiere straps 65 and 67 attach to the posterior brassiere straps 66 and 68 by adjustable loops 73 and 74 for manual adjustment of each strap on the shoulders of the wearer. The anterior strap 65 establishes a superior force vector as shown in FIG. 4.

Figure 5:
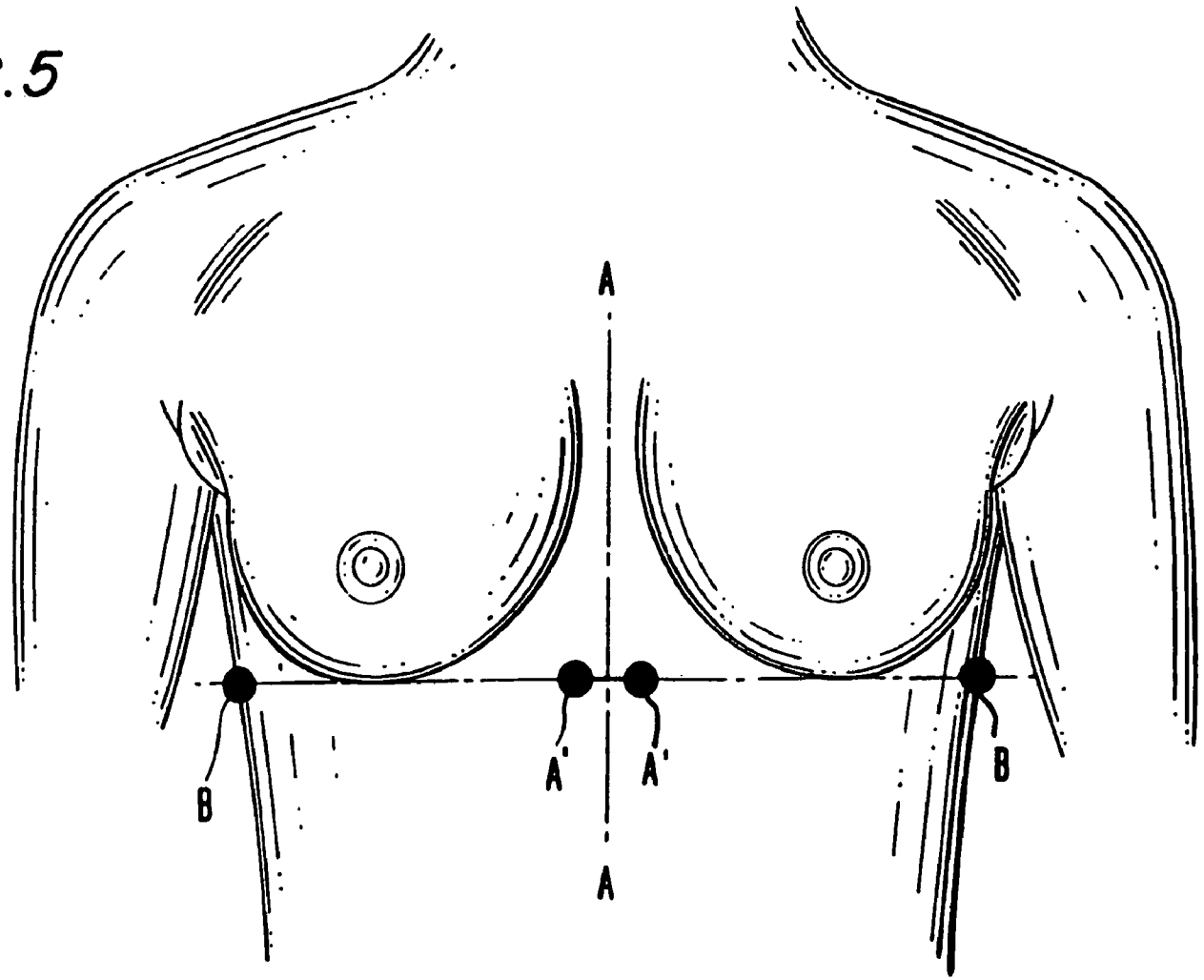
FIG. 5 is an anatomic rendering of the naked breast with points that define the base width breast measurement which correspond to the base of the extended breast cup

As explained hereinbefore, the anthropometric standard will be achieved by designing the brassiere so that the base width measurement of each breast cup when extended stays within a fixed linear measurement of between 11.5 to 13.5 centimeters. The measurement is a linear one preferably taken as shown in FIG. 5 between points A' and B on the chest. The position A—A corresponds to the midline of the chest with A' corresponding to the medial extent of the breast, and points B correspond to the respective positions at the lateral extent of each breast anatomically, as is known to those skilled in the medical profession. The measurements between points A, A' and B can readily be measured on a brassiere in the extended position and they should correspond to those measurements on the body as seen in FIG. 5.

What is claimed is:

1. A brassiere comprising two brassiere cups each having an equal number of two or more panel sections representing by at least a lateral sling panel section and a main panel section respectively with the panel sections of each breast cup arranged such that the lateral panel section acts as a sling and possesses substantially less elasticity than is possessed by the superior panel section such that the brassiere satisfies a narrow base width measurement for each breast cup of between 11.5 and 13.5 centimeters when the brassiere is extended.

2. A brassiere as defined in claim 1 further comprising an anterior support member for each breast cup and a soft support member with the anterior support member being secured at its superior edge to the lateral sling panel section and to the soft support member so that the base width correlates to the breast anthropometrical standard applicable to most women.

3. A brassiere as defined in claim 2 wherein the anterior support member is connected to the main panel section of each breast cup at a common junction with said soft support member with the junction substantially conforming in shape to the inframammary fold lower curvature of the breast.

4. A brassiere as defined in claim 2 wherein said soft support member is reinforced posteriorly with a fabric.

5. A brassiere as defined in claim 2 wherein said soft support member is secured within a single piece of double-faced knitted fabric.

6. A brassiere as defined in claim 3 wherein the anterior support member extends rearwardly around the brassiere for attachment to the brassiere to the back of the wearer.

7. A brassiere as defined in claim 6 wherein said anterior support member comprises either a single or double layer of fabric and an elastic band adjacent the fabric.

8. A brassiere as defined in claim 1 wherein said main panel section of each breast cup has an elasticity defined by an average length stretch and an average width stretch which is substantially more than twice the average length stretch and an average width stretch of lateral sling panel.

9. A brassiere as defined in claim 8 wherein said lateral sling panel section of each breast cup has an elasticity defined by a 5% average length stretch and a 6.2% average width stretch and said main penal section has an elasticity defined by a 130% average length stretch and an 75% average width stretch.

10. A brassiere as defined in claim 8 wherein said main panel section of each breast cup has a ball busting strength which is substantially greater than the comparative ball busting strength of the lateral sling panel section.

11. A brassiere as defined in claim 10 wherein said main and lateral panel sections can be woven from a single piece of fabric.

12. A brassiere as defined in claim 8 wherein said main panel section of each breast cup extends superiorly above that of the lateral sling panel section.

13. A brassiere as defined in claim 12 wherein said main panel section extends superiorly to a position which will just cover the nipple areola complex of the breast.

14. A brassiere as defined in claim 8 wherein the lateral panel section of each breast cup has a lower edge shaped to follow the inframammary fold lower curvature of the breast.

15. A brassiere as defined in claim 8 further comprising a side panel and an anterior breast strap for each breast cup with each side panel connected to a corresponding lateral panel section of each breast cup respectively at the lateral extent of each lateral panel section and extending superiorly and laterally toward the anterior breast strap to which the lateral panel section is also secured.

16. A brassiere as defined in claim 15 wherein the side panels attach to the lateral sections of the breast cups at a the junction of the soft support member.

* * * * *